US006357799B1

(12) United States Patent
Shibata et al.

(10) Patent No.: US 6,357,799 B1
(45) Date of Patent: Mar. 19, 2002

(54) PRINTED MATTER

(75) Inventors: Masaaki Shibata; Tohru Hayano, both of Osaka (JP)

(73) Assignee: Etsuo Shibata, Osaka (JP)

( * ) Notice: Subject to any disclaimer, the term of this patent is extended or adjusted under 35 U.S.C. 154(b) by 0 days.

(21) Appl. No.: 09/499,689

(22) Filed: Feb. 8, 2000

(30) Foreign Application Priority Data

Feb. 9, 1999 (JP) ..... 11-031492

(51) Int. Cl.[7] ..... B42D 15/00
(52) U.S. Cl. ..... 283/91; 283/72; 428/913
(58) Field of Search ..... 283/91, 114, 95, 283/92, 93, 56, 117, 903, 102, 72; 428/913

(56) References Cited

U.S. PATENT DOCUMENTS 4,241,943 A * 12/1980 Malinovitz ..... 283/13
4,796,921 A * 1/1989 Neiman ..... 283/91
5,135,260 A * 8/1992 Irlick et al. ..... 283/2
5,282,917 A * 2/1994 Danelski ..... 283/98
5,286,061 A * 2/1994 Behn ..... 283/95
5,769,458 A * 6/1998 Carides et al. ..... 283/102
5,925,440 A * 7/1999 Farag et al. ..... 428/195
5,941,572 A * 8/1999 Gundjian et al. ..... 283/67
5,984,367 A * 11/1999 Barnhart et al. ..... 283/92
6,047,964 A * 4/2000 Lawandy et al. ..... 273/138.1

* cited by examiner

*Primary Examiner*—Willmon Fridie, Jr.
(74) *Attorney, Agent, or Firm*—Wenderoth, Lind & Ponack, L.L.P.

(57) ABSTRACT

This invention pertains to a printed matter in which it is difficult to confirm an image in the state before the image appears, and by scratching the print surface with a coin a brilliant image appears. On a print substrate, an image of a ink composition containing a material having a greater hardness than that of the metal of a coin or medal, and a print layer having a contrast with respect to the print substrate or the image are printed. By effectively using human visual recognition characteristics, the print layer having a contrast is recognized very strongly, so that the masking effect and the effect of attention occur. This makes it difficult to recognize what image is printed not only when the printed matter is seen from front, but also when it is seen sidewise. Thus, even if light is shed on the printed matter, the image cannot be seen.

21 Claims, 3 Drawing Sheets

PRINTED MATTER

BACKGROUND OF THE INVENTION

This invention relates to a printed matter in which an image hidden under a print surface is very difficult to confirm in the state before the image appears, and in which the image appears by scratching the print surface with a coin or medal or by applying pressure from above.

Heretofore, for example as proposed in Examined Japanese patent publication 6-78039, there is known a printed matter in which an image such as a picture or a numeral is printed, with an ink composition containing a material having a greater hardness than that of a metal of a coin, onto a print substrate, and in which by scratching the printed part of the image from above, the image appears.

There is also known a printed matter in which on the image, a print layer is superposed by full-space solid printing, screen solid printing or over-print varnish printing, or a masking layer using silver ink is printed on the image to make the image invisible in such a manner that the print layer or the masking layer can be peeled off to let the image appear.

For the first printed matter as described above, there is a problem in that a difference in glitter is produced between the print substrate and the printed surface on which an image is printed with an ink composition, so that by changing the looking angle, even in the state before the printed surface is scratched, the image printed on the print substrate can be confirmed, or the image can be seen if light is shed thereon.

Also, the latter printed matter has some image masking effect, but if the masking layer is by mono-color solid printing, only a simple printed matter can be made.

Therefore, an object of this invention is to provide a printed matter in which human visual recognition characteristics are used effectively, and when in the state before the image appears, it is difficult to confirm the image due to optical illusion, and still, the image cannot be seen even if light is shed thereon. The printed matter is complicated in color and pattern, and a brilliant image appears by scratching the printed surface with a coin or by applying pressure from above.

SUMMARY OF THE INVENTION

According to this invention, there is provided a printed matter wherein an image is printed on a substrate with an ink composition, and further wherein a print layer having a contrast with respect to the substrate is printed on the substrate to induce optical illusion relative to the image utilizing visual recognition characteristics.

Other features and objects of the present invention will become apparent from the following description made with reference to the accompanying drawings, in which:

DETAILED DESCRIPTION OF THE PREFERRED EMBODIMENT

Hereinbelow, an embodiment of this invention is described with respect to the accompanying drawings.

First, characteristics of human visual recognition are listed below.

(1) Human vision strongly recognizes a contrast.

(2) If two stimuli are given in proximity to each other in time and space, a large stimulus is recognized while a small one is not. As a result, what is called a masking phenomenon occurs.

(3) Separated figures are difficult to distinguish.

In the so-called "the effect of attention", if attention is directed to one stimulus, perception toward other stimuli weakens.

For the printed matter of this invention, such human visual recognition characteristics are used effectively. In the state before the image appears, it is difficult to confirm the image even by the eye, and still, the image cannot be seen even if light is shed thereon. But a brilliant image appears by scratching the printed surface with a coin or by applying pressure from above.

Figure 1:
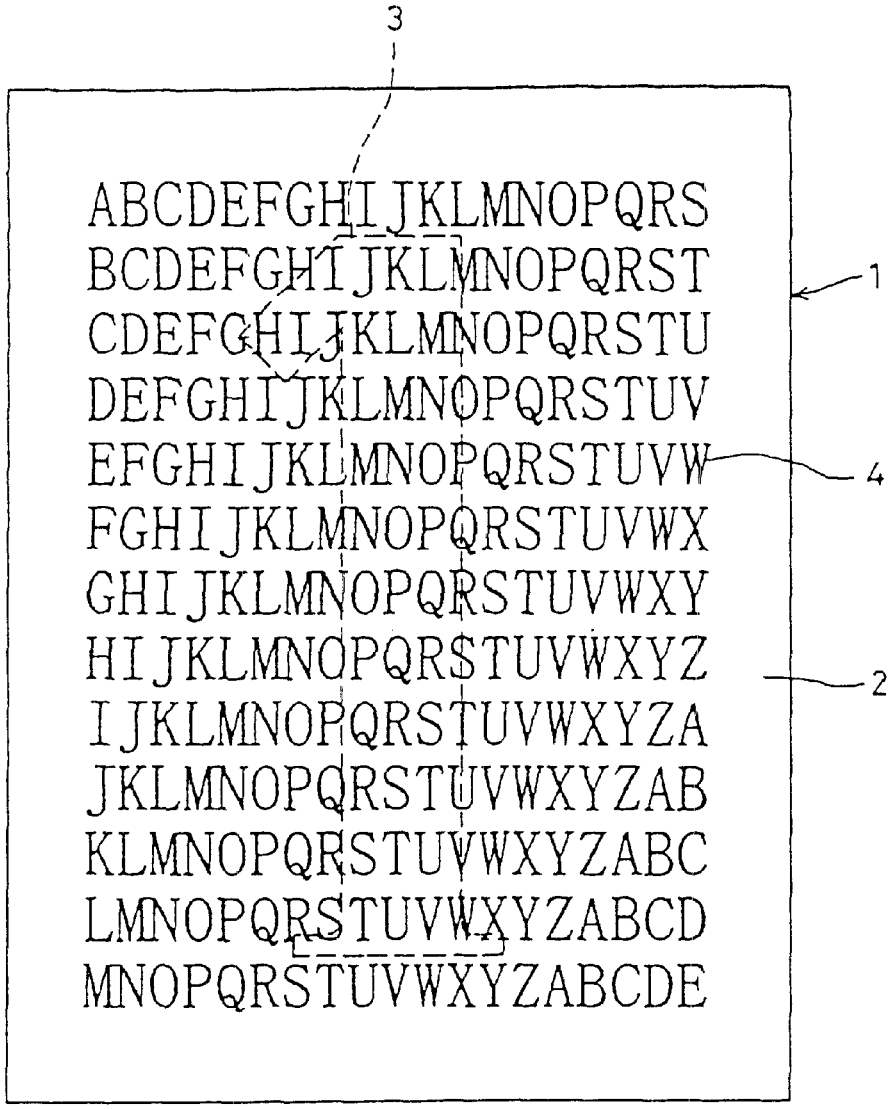
FIG. 1 is a front view showing the printed matter according to this invention.
Figure 2:
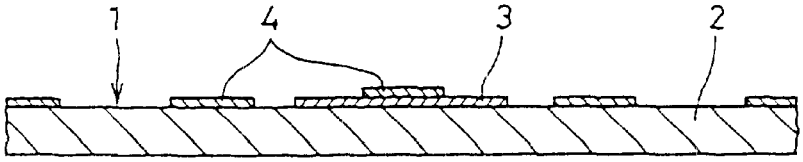
FIG. 2 is an enlarged vertical sectional side view showing the printed matter of this invention.
Figure 3A:
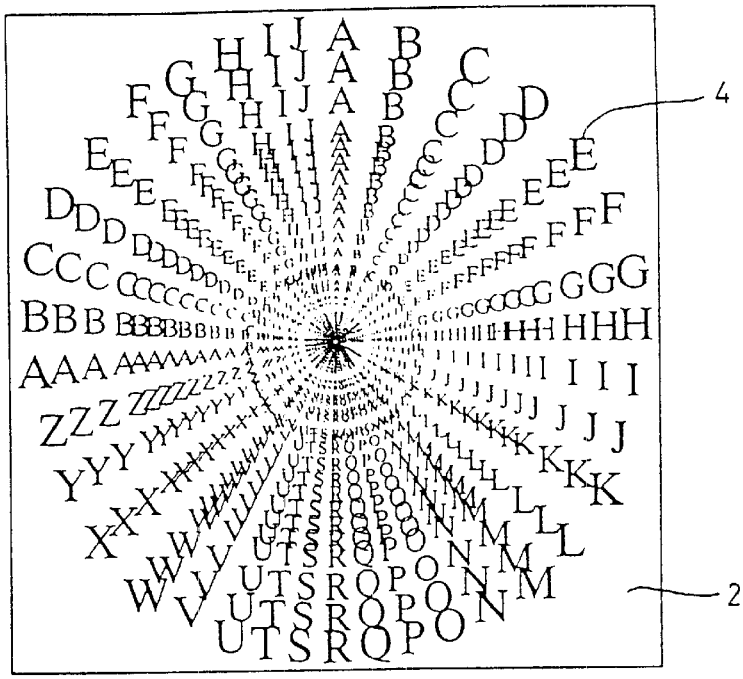
FIGS. 3A and 3B are views showing different patterns of the print layer in the printed matter of this invention.
Figure 3B:
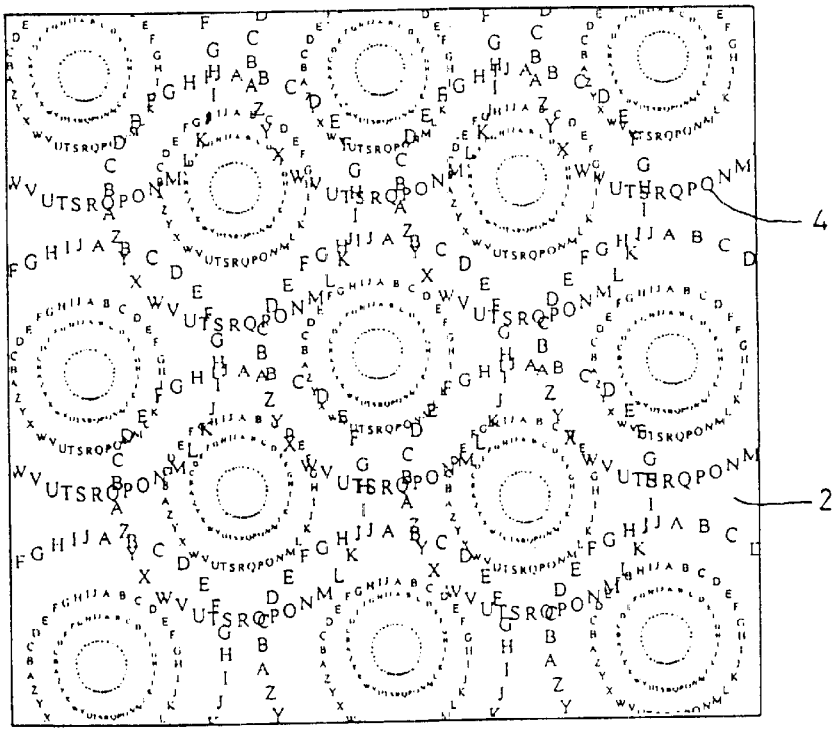
Figure 4A:
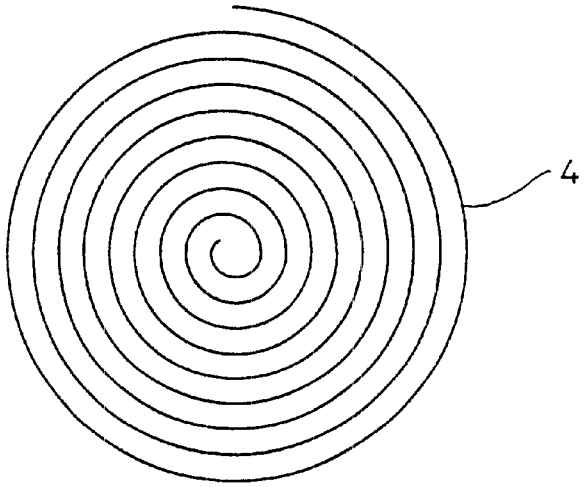
FIGS. 4A to 4C are views showing other patterns of the same.
Figure 4B:
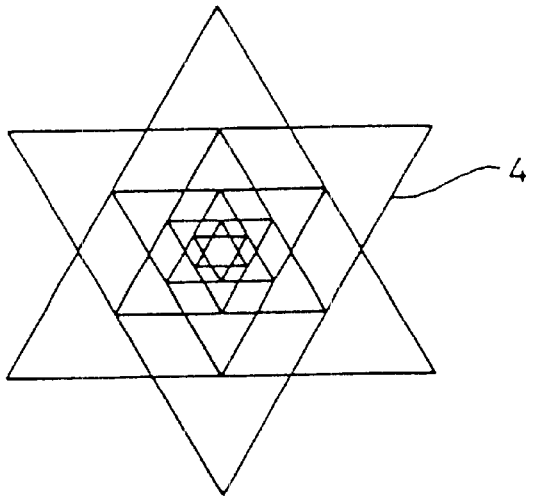
Figure 4C:
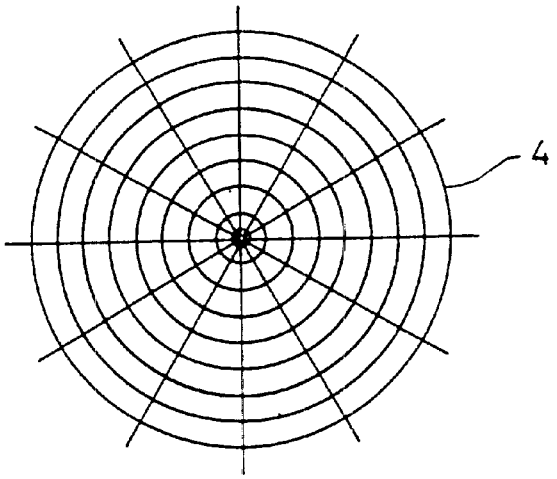

The printed matter 1 of this invention is, as shown in FIGS. 1 and 2, formed by printing on a print substrate 2 such as paper, an image 3 using an ink composition containing a material having a greater hardness than that of a metal of a coin or medal, and a print layer 4 having a contrast with respect to the printed substrate 2 or image 3 on the image 3 to induce optical illusion relative to the image by utilizing visual recognition characteristics.

In FIGS. 1 and 2, there is shown an embodiment in which the print layer 4 is printed on the image 3 so as to hide the image 3.

As described above, by superposing the image 3 and the print layer 4 having a contrast with respect to the print substrate 2 or image 3 over the entire surface of the print substrates or only in the region where there is the image 3, the print layer 4 is recognized very strongly, so that the visual masking effect and the effect of attention occur. Thus even if it is seen not from front but sidewise, it is possible to make it difficult to recognize what image 3 is printed. Further, due to the presence of the print layer 4 on the image 3, the image is not seen even if light is shed on the printed matter 1.

If the image 3 is printed with a white ink composition on a white print substrate 2, and the print layer 4 is printed with green ink, the print layer 4 will give a strong stimulus, so that visual effect such as masking effect and the effect of attention is produced and the image cannot be recognized.

As an ink composition for printing the image 3 on the print substrate 2, a material containing a material having a greater hardness than that of a metal of a coin such as titanium oxide, aluminum oxide, silicon dioxide, chromium oxide in an amount of 10–80% may be used. These materials have a Mohs hardness of between 5.5 and 9.0. The image 3 such as a numeral, letter or bar code may be printed in any color by offset, gravure, screen or letter press printing.

The color of the paper used for the print substrate 2 may not be white. The quality and thickness of the paper may also be freely selectable according to the purpose and use. Also white-colored or light-colored printing may be applied to the paper surface. The combination of the color of the ink composition for printing the image 3 and the color of the print substrate may be freely selected so long as a contrast is eventually obtained.

FIGS. 3A, 3B and 4A to 4C show as examples several patterns of the print layer 4 to be printed on the print substrate 2. In the illustrated case, geometrical patterns are shown. But non-geometrical patterns, design marks, trademarks, pictures, numerals or letters may be freely used.

For the ink used for the formation of the print layer 4, one used in general printing can be used. As the printing method, offset, gravure, screen, letter press printing or the like may be employed. The print layer 4 may be expressed not only in single color or light and shade of single color, but also in multi-color printing using two or more colors.

For example, if the print layer 4 having a contrast is expressed in a single color, combination of the color of the pattern and the color of the paper can give a brilliant contrast. The print layer 4 may be printed not only over the entire surface of the print substrate 2 but a mark may be printed in a one-point manner.

Human eyes have a visual nature of strongly recognizing a contrast, so that when a picture or pattern having a contrast relative to the print substrate 2 is seen, it is strongly caught whereas the image 3 having weak contrast relative to the substrate is hardly recognized by the brain. That is to say, when the vision catches the print layer 4 including the printed picture or pattern, the image 3 present under the print layer 4 will not enter the eye.

As described above, if a print layer 4 of a picture or pattern having a contrast with respect to the print substrate 2 is printed on the print substrate 2, due to the optical illusion effect that occurs due to human visual characteristics, only the print layer 4 of a picture or pattern having a contrast is selectively caught, thereby making it more difficult to recognize the image 3.

Also, due to the presence of the print layer 4 of a picture or pattern having a contrast with respect to the image 3 and the print substrate 2 and at least partially overlapped on the image 3, even when light is shed on the printed matter 1, it is possible to prevent the image 3 from being seen.

For the printed matter thus formed, normally the image 3 cannot be recognized. When the portion of the image 3 is scratched with a coin from above the printed layer 4, the image 3 in the printed layer 4 will appear brilliantly. Thus as a substitute for a so-called scratch card, it can be used for a lottery. Security is maintained by printing it on part of important papers and products. Also, it can be used for many purposes such as judgment of forging and whether papers or products are authentic or counterfeit.

For the printed matter 1, an ink composition containing a material having a greater hardness than that of the metal of a coin is used. If one in which a magnetic material is mixed with a printing ink is used for the printing of the image 3, it is possible to read the image by a magnetic device without scratching it from above. Also, if an ordinary ink is used for the printing of the image 3 and the print substrate 2, image 3 and print layer 4 are optically read using differences between wavelengths of colors, and it is possible to provide an invisible bar code or two-dimensional code.

Also, by using a special ink that produces a magnetic field, ultraviolet rays or infrared rays, for the image 3 such as a bar-code or a two-dimensional code, and by printing the print layer 4 of a picture or pattern having a contrast thereon, it is possible to provide a printed matter having a vast amount of information which cannot be seen by human eyes but can be read optically.

Further, by forming the printed matter 1 in which an ink containing a developer is used for the printing of the image 3, and the print layer 4 having a contrast is printed thereon to hide the image, applying a color former on a sheet of paper superposed on the printed matter 1, and then applying pressure from the sheet superposed on the printed matter 1, the image 3 on the printed matter 1 develops color due to chemical reaction between the color former on the sheet of paper and the developer in the image 3. Such is the case with a no-carbon paper used as a slip.

According to the present invention, by inducing the masking effect and the effect of attention utilizing human visual recognition characteristics, it is difficult to recognize the image to the eye when viewed from the front or side. If the image is overlapped with the print layer, the image cannot be seen even if shed with light.

Simply by covering the image with the print layer having a contrast, it is possible to hide the image before the print layer is scratched by a coin or the image is read magnetically or optically. Thus the printed matter according to the present invention can be used for lotteries, toys and two-dimensional bar codes for preventing forgery of documents and products, and can be produced at a low cost.

What is claimed is:

1. A printed matter comprising:

a substrate having a surface;

an image on said surface of said substrate, wherein said image is substantially invisible against said surface; and a print layer on said surface of said substrate and having a contrast relative to at least one of said image and said surface, such that an optical illusion is induced with respect to said image, wherein said print layer overlays at least a portion of said image such that, absent said print layer said image is substantially invisible when viewed in a first direction and is generally visible when viewed in a second direction, and the optical illusion induced by said print layer renders said image substantially invisible when viewed in said second direction.

2. A printed matter comprising:

a substrate having a surface;

an image on said surface of said substrate, wherein said image includes an ink composition that is substantially invisible against said surface; and a print layer on said surface of said substrate and having a contrast relative to at least one of said image and said surface, such that an optical illusion is induced with respect to said image, wherein said print layer overlays at least a portion of said image such that, absent said print layer said image is substantially invisible when viewed in a first direction and is generally visible when viewed in a second direction, and the optical illusion induced by said print layer renders said image substantially invisible when viewed in said second direction, such that when a coin is rubbed across said image, material of said coin is removed by said ink composition and adhered thereto such that said image becomes substantially visible.

3. A printed matter comprising:

a substrate having a surface;

an image on said surface of said substrate, wherein said image is substantially invisible against said surface; and a print layer on said surface of said substrate such that said print layer overlays at least a portion of said image, with said print layer having a contrast relative to at least one of said image and said surface such that an optical illusion is induced with respect to said image, and with said print layer being physically separate from said image, wherein said image is substantially invisible against said surface of said substrate absent said print layer.

4. A printed matter comprising:

a substrate having a surface;

an image on said surface of said substrate, wherein said image includes an ink composition that is substantially invisible against said surface; and a print layer on said surface of said substrate such that said print layer overlays at least a portion of said image, with said print layer having a contrast relative to at least one of said image and said surface such that an optical illusion is induced with respect to said image, and with said print layer being physically separate from said image, wherein said image is substantially invisible against said surface of said substrate absent said print layer, such that when a coin is rubbed across said image, material of said coin is removed by said ink composition and adhered thereto such that said image becomes substantially visible.

5. A printed matter comprising:

a substrate having a surface;

an image on said surface of said substrate, wherein said image includes an ink composition that is substantially invisible against said surface and contains at least one material selected from the group consisting of titanium oxide, aluminum oxide, silicon dioxide and chromium oxide, in an amount of 10%–80%; and a print layer on said surface of said substrate such that said print layer overlays at least a portion of said image, with said print layer having a contrast relative to at least one of said image and said surface such that an optical illusion is induced with respect to said image, and with said print layer being physically separate from said image, wherein said image is substantially invisible against said surface of said substrate absent said print layer.

6. A printed matter comprising:

a substrate having a surface;

an image on said surface of said substrate, wherein said image includes an ink composition that is substantially invisible against said surface and has a Mohs hardness of between 5.5 and 9.0; and a print layer on said surface of said substrate such that said print layer overlays at least a portion of said image, with said print layer having a contrast relative to at least one of said image and said surface such that an optical illusion is induced with respect to said image, and with said print layer being physically separate from said image, wherein said image is substantially invisible against said surface of said substrate absent said print layer.

7. The printed matter according to claim 3, wherein said print layer includes at least two colors.

8. The printed matter according to claim 7, wherein said print layer includes a geometric pattern.

9. The printed matter according to claim 3, wherein said print layer includes a geometric pattern.

10. The printed matter according to claim 3, wherein said image includes an ink composition containing a magnetic material, such that said image can be detected via a magnetic device.

11. The printed matter according to claim 3, wherein said image includes an ink composition that can be optically detected, such that said image and said print layer can be optically read by utilizing differences between wavelengths of colors.

12. The printed matter according to claim 3, wherein said image includes an ink composition that can produce one of ultraviolet rays and infrared rays.

13. The printed matter according to claim 3, wherein said image includes an ink composition containing a developer, such that when a sheet containing a color former is superposed on said image and pressure is applied to the sheet, said image develops color due to chemical reaction between the color former of said sheet and the developer in said image.

14. The printed matter according to claim 4, wherein said print layer includes at least two colors.

15. The printed matter according to claim 4, wherein said print layer includes a geometric pattern.

16. The printed matter according to claim 5, wherein said print layer overlays at least a portion of said image such that, absent said print layer said image is substantially invisible when viewed in a first direction and is generally visible when viewed in a second direction, and the optical illusion induced by said print layer renders said image substantially invisible when viewed in said second direction.

17. The printed matter according to claim 5, wherein said print layer includes at least two colors.

18. The printed matter according to claim 5, wherein said print layer includes a geometric pattern.

19. The printed matter according to claim 6, wherein said print layer overlays at least a portion of said image such that, absent said print layer said image is substantially invisible when viewed in a first direction and is generally visible when viewed in a second direction, and the optical illusion induced by said print layer renders said image substantially invisible when viewed in said second direction.

20. The printed matter according to claim 6, wherein said print layer includes at least two colors.

21. The printed matter according to claim 6, wherein said print layer includes a geometric pattern.

* * * * *